US005100131A

United States Patent [19]

Fong

[11] Patent Number: 5,100,131

[45] Date of Patent: Mar. 31, 1992

[54] BACK MUSCLE EXERCISING AND STRETCHING APPARATUS

[76] Inventor: Walter Fong, 4122 Shorebreak Dr., Huntington Beach, Calif. 92649

[21] Appl. No.: 713,884

[22] Filed: Jun. 12, 1991

[51] Int. Cl.[5] ..... A63B 00/23

[52] U.S. Cl. ..... 482/112; 482/134; 482/137; 482/139

[58] Field of Search ..... 272/144, 93, 137, 116, 272/130, 134, 138, 94; 5/62, 72, 431, 432, 433, 446; 128/25 R, 69

[56] References Cited

U.S. PATENT DOCUMENTS

| | | | |
|---|---|---|---|
| 4,583,731 | 4/1986 | Crivello | 272/137 |
| 4,927,139 | 5/1990 | Taltre | 272/144 |

FOREIGN PATENT DOCUMENTS

| | | | |
|---|---|---|---|
| 0121902 | 10/1984 | European Pat. Off. | 272/134 |
| 3632124 | 9/1986 | Fed. Rep. of Germany | 272/144 |

*Primary Examiner*—Richard J. Apley
*Assistant Examiner*—Jerome Donnelly
*Attorney, Agent, or Firm*—Stetina and Brunda

[57] ABSTRACT

A back muscle exercising and stretching apparatus comprises a stationary seat upon which a user may sit, a backrest movably attached to the seat, and a resistance means, such as a hydraulic or pneumatic spring, movably attached to the seat and the backrest to define the force required to move the backrest relative to the seat. The user may sit either facing toward or away from the backrest and then bend either forward or backward to cause the backrest to move from a substantially vertical position to a substantially horizontal position. Higher resistances may be used to effect exercise and lower resistances may be used to effect stretching. The apparatus may be placed in a convex table-like orientation such that the user may lay face up thereon to effect stretching of the back muscles. An optional headrest increases comfort and permits the patient to exercise and stretch portions of the upper back and neck.

11 Claims, 1 Drawing Sheet

BACK MUSCLE EXERCISING AND STRETCHING APPARATUS

FIELD OF THE INVENTION

The present invention relates generally to chiropractic therapy devices and more particularly to a back muscle exercising and stretching apparatus.

BACKGROUND OF THE INVENTION

Chiropractic devices for exercising and stretching the back muscles are well known. Such devices typically comprise tables having movable portions which may be tensioned to provide resistance to the patient's movements such that therapeutic results are achieved when the patient straightens and flexes his back.

The need to exercise and stretch the back muscles is well known in the medical arts. Such exercise and stretching is necessary as both a beneficial activity for healthy individuals and as therapy for those with diseased or injured muscles.

In healthy individuals this exercising and stretching of the back muscles occurs as a normal part of daily activity. However, for those individuals with diseased or injured back muscles, stretching and exercising must occur within a well-defined regimen of therapeutic activity. Such therapeutic activity may include the stretching and exercising of the back muscles through the performance of simple exercises. Alternatively, specially constructed equipment may be utilized to effect the desired therapy to the particular affected muscles.

Prior art devices are typically large, elaborate, and expensive apparatus which require extensive set up and skill to use properly. Thus, the prior art devices cannot be easily transported. They also cannot be operated by untrained personnel. As such, although the prior art has recognized to a limited extent the need for back muscle exercising and stretching devices, the proposed solutions have to date been ineffective in providing a satisfactory remedy.

SUMMARY OF THE INVENTION

The present invention specifically addresses and alleviates the above-mentioned deficiencies associated in the prior art. More particularly, the present invention comprises a back muscle exercising and stretching apparatus comprising a stationary seat upon which a user may sit, a backrest movably attached to the seat, and a resistance means, such as a hydraulic or pneumatic spring, movably attached to the seat and the backrest to define the force required to move the backrest relative to the seat.

The user may sit either facing toward or away from the backrest and then bend either forward or backward to cause the backrest to move from a substantially vertical position to a substantially horizontal position. Higher resistances may be used to effect exercise and lower resistances may be used to effect stretching. The apparatus may be placed in an upwardly curved convex table-like orientation such that the user may lay face up thereon to effect stretching of the back muscles.

An optional headrest increases comfort and permits the patient to exercise and stretch the upper back and neck. A seat belt is provided to help isolate the lower back muscles during exercising by preventing the use of the leg muscles. The seat belt may also be used to prevent older and infirm patients from accidentally slipping off of the apparatus.

DETAILED DESCRIPTION OF THE PREFERRED

The detailed description set forth below in connection with the appended drawings is intended as a description of the presently preferred embodiment of the invention, and is not intended to represent the only form in which the present invention may be constructed or utilized. The description sets forth the functions and sequence of steps for constructing and operating the invention in connection with the illustrated embodiment. It is to be understood, however, that the same or equivalent functions and sequences may be accomplished by different embodiments that are also intended to be encompassed within the spirit and scope of the invention.

Figure 1:
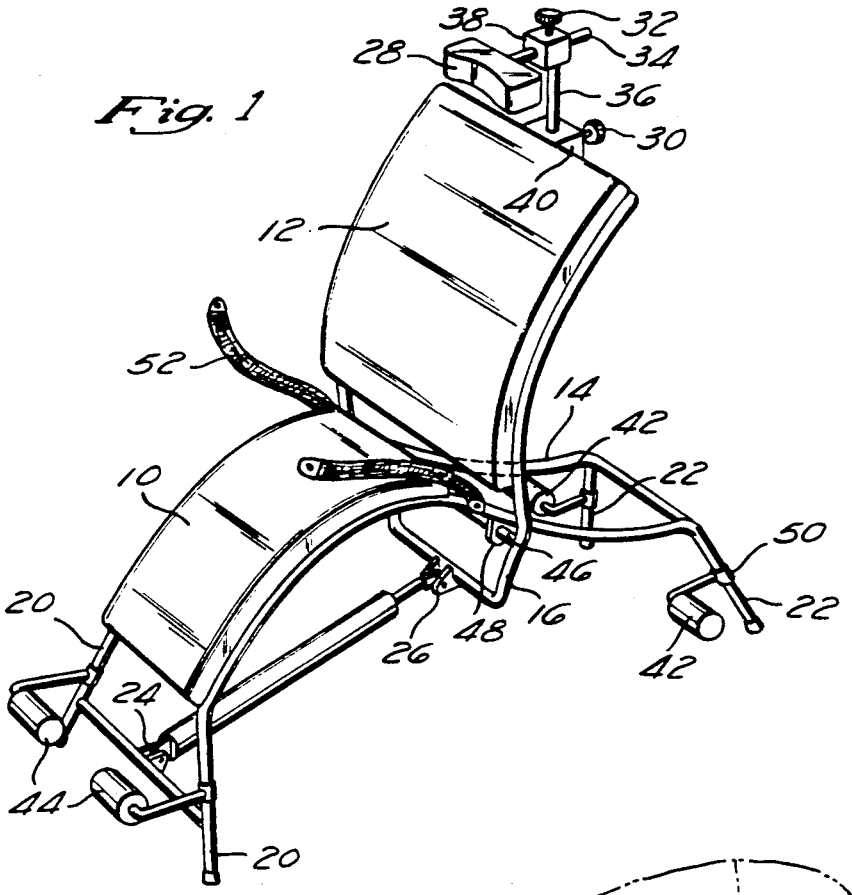
FIG. 1 is a perspective view of the back muscle exercising and stretching apparatus of the present invention.

The back muscle stretching and exercising apparatus of the present invention is illustrated in FIGS. 1–4 which depict a presently preferred embodiment of the invention. Referring now to FIG. 1, the back muscle exercising and stretching apparatus is comprised generally of a stationary seat 10, a backrest 12 movably attached to the seat, and a resistance means 18, such as a hydraulic or pneumatic spring, interconnecting the seat 10 and backrest 12 to define the force required to move the backrest relative to the seat 10. The rest unstressed position of the resistance means is with the backrest 12 in the vertical position. A pair of forward foot supports 44 are attached to the forward legs 20 and a pair of rear foot supports 42 are attached to the rear legs 22. A seat belt 52 is attached to the seat 10 such that a user may be secured thereto.

An optional head pad 28 may be adjustably attached to the backrest 12 via a horizontal support 34, a vertical support 36, a horizontal positioning block 38, and a vertical positioning block 40. A horizontal position adjusting bolt 32 may be utilized to lock the head pad in its horizontal position and a vertical positioning bolt 30 may be used to lock the head pad 28 in its vertical position.

The seat pad 10 is preferably attached to a stationary tubular frame 14 and the backrest pad 12 is preferably to a movable tubular frame 16. A pivot bar 46 pivotally attaches the movable frame 16 to the stationary frame 14 through the pivot brackets 48.

The resistance means 18 is attached to the stationary frame 14 via the proximal pivot attachment 24 and is likewise attached to the movable frame 16 via the distal pivot attachment 26.

Although the construction of the back muscle exercising and stretching apparatus of the present invention is illustrated as having the resilient pads of the seat 10 and the backrest 12 attached to tubular metal frameworks 14 and 16, respectively, those skilled in the art will recognize that various other constructions, i.e. wood, molded plastic, composite epoxies, are likewise suitable.

Having thus described the structure of the back muscle exercising and stretching apparatus of the present invention, it may be beneficial to describe the operation thereof.

Figure 2:
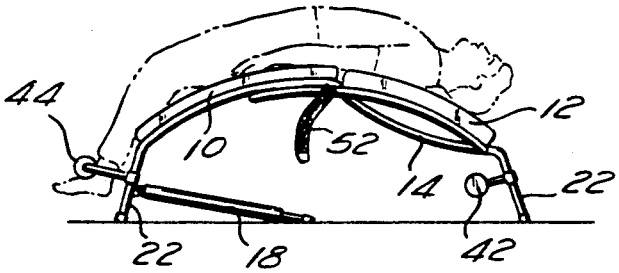
FIG. 2 is a side elevation view of the back muscle exercising and stretching apparatus of the present invention with the backrest disposed in the horizontal position and showing a person lying thereupon to effect stretching of the back muscles.

Referring now to FIG. 2, one end of the resistance means 18 may be disconnected from either the movable frame 16 or the stationary frame 14 as illustrated to permit the backrest 12 to lie in a substantially horizontal position. Alternatively, the backrest 12 may be urged against the resistance of the resistance means 18 into the horizontal position and locked in place. Optionally, the resistance of the resistance means 18 may be decreased to approximately zero, such that the backrest 12 may be easily repositioned to the substantially horizontal position.

After placing the backrest 12 in the substantially horizontal position as shown in FIG. 2, a user may lie face up upon the stationary seat 10 and backrest 12 such that the patient's back is arched upwards to stretch the muscles thereof. The patient's feet may be supported by the forward foot supports 44 to maintain their position and to facilitate the patient's rising from this lying position.

Figure 3:
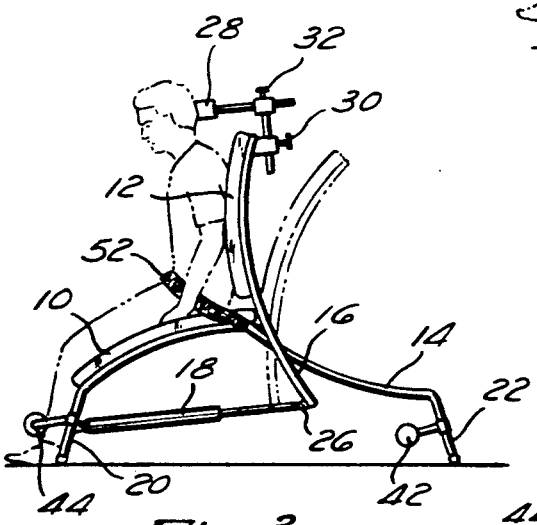
FIG. 3 is a side elevation view of the back muscle exercising and stretching apparatus of the present invention showing a person seated thereupon facing away from the backrest such that he may straighten his body to affect stretching and/or exercising of the extensor back muscles.

To exercise the back extensor muscles, the user may sit facing away from the backrest 12, i.e. with his back against the backrest 12. The user's head may optionally be placed against the head pad 28. In use, the head pad 28 should be adjusted in height and horizontal position such that it is positioned substantially as shown in FIG. 3 relative to the user's head. The seat belt 52 may be utilized to secure the user to the back muscle exercising and stretching apparatus. The seat belt 52 will be most useful when the back muscle exercising and stretching apparatus is being used by elderly and/or infirm persons. The seat belt 52 also isolates the muscles of the lower back by preventing the patient from using his legs to effect movement of the backrest 12. This insures that the maximum intended therapeutic benefit is derived from the exercise. The resistance means 18 should be adjusted such that the extensor back muscles are properly exercised when the patient straightens his lower back to affect movement of the backrest 12. Such strengthening of the patient's lower back urges the backrest 12 from its substantially vertical position toward its substantially horizontal position.

Thus, to exercise the back muscles, the user straightens his lower back such that the backrest 12 is forced downward into a substantially horizontal position, similar to that shown in FIG. 2. The user may pause momentarily in that position, then rise back to the position illustrated in FIG. 3 and repeat as required for proper therapeutic effect. Reducing the resistance required to move the backrest 12 to a minimum amount permits the user to stretch the back muscles by performing the above-described extension muscle exercise. Thus, a patient may stretch the back muscles without excessively exerting them.

Figure 4:
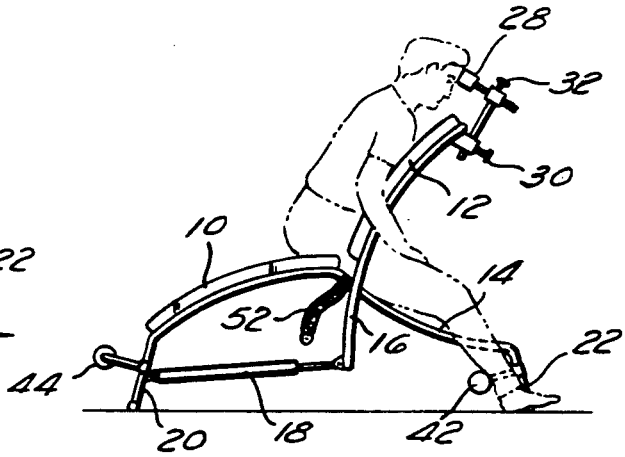
FIG. 4 is a side elevation view of the back muscle exercising and stretching apparatus of the present invention showing a person seated thereupon facing the backrest such that the person may bend forward to effect stretching and/or exercising of the flexor back muscles.

Referring now to FIG. 4, the back muscle exercising and stretching apparatus of the present invention may be utilized to exercise the flexor muscles of the back by positioning the patient thereon such that the patient is facing, i.e. chest against, the backrest 12. The resistance means 18 is adjusted such that the patient may bend forward by pressing the backrest 12 with his chest while using sufficient force to achieve a desired therapeutic effect. Again, the head pad 28 may be utilized and should therefore first be adjusted to a position relative to the user's head substantially as shown in FIG. 4. The rear footrest 42 may be utilized to provide added support to the user. Reducing the force provided by the resistance means to a minimum value permits the user to stretch the back muscles by repeating the above-described flexor muscle exercise without substantial resistance.

It is understood that the exemplary back muscle exercising and stretching apparatus of the present invention described herein and shown in the drawings represents only a presently preferred embodiment of the invention. Indeed, various modifications and additions may be made to such embodiment without departing from the spirit and scope of the invention. For example, the substantially flat, rectangular configurations of the seat and backrest pads as depicted and described may be varied such that they conform more closely to the contours of the human body. Indeed, the pads need not be substantially rectangular in shape as depicted, but rather may be of various shapes and configurations as those skilled in the art will recognize. Additionally, the backrest need not be pivotally attached to the seat, nor must it move in a generally arc-like motion. Those skilled in the art will recognize that various attachment means and movements are suitable. Thus, these and other modifications and additions may be obvious to those skilled in the art and may be implemented to adapt the present invention for use in a variety of different applications.

What is claimed is:

1. A back muscle exercising and stretching apparatus, comprising:

(a) a stationary frame member defining a seat;

(b) a backrest frame member movably attached to said stationary frame member to be movable between a rest position and an actuated position, said rest position being generally vertical and said actuated position being generally horizontal;

(c) a resistance means connected to said stationary frame member and said backrest frame member;

said stationary frame member and said backrest frame member being formed to provide in combination, a substantially continuous arcuate radius for stretching the back muscles when said backrest frame member is disposed in said actuated position.

2. The back muscle exercising and stretching apparatus as recited in claim 1 wherein said resistance means is adjustable such that the force required to move said backrest frame member relative to said stationary frame member may be varied as desired.

3. The back muscle exercising and stretching apparatus as recited in claim 2 wherein said resistance means comprises a pneumatic spring.

4. The back muscle exercising and stretching apparatus as recited in claim 2 wherein said resistance means comprises a hydraulic spring.

5. The back muscle exercising and stretching apparatus as recited in claim 2 further comprising at least two foot supports connected to said stationary frame member.

6. The back muscle exercising and stretching apparatus as recited in claim 5 further comprising a seat belt attached to said stationary frame member.

7. The back muscle exercising and stretching apparatus as recited in claim 6 further comprising a head support attached to said frame member.

8. The back muscle exercising and stretching apparatus as recited in claim 7 wherein said seat support is adjustable.

9. The back muscle exercising and stretching apparatus as recited in claim 1 wherein said seat stationary frame member and said backrest frame member define an arcuate radius between 0.5 meter and 1.5 meters.

10. The back muscle exercising and stretching apparatus as recited in claim 1 wherein said stationary frame member and said backrest frame member define an arcuate radius of approximately 1 meter.

11. A back muscle exercising and stretching apparatus, comprising:

(a) a first frame;

(b) a seat pad attached to said first frame such that a person may sit thereon;

(c) a second frame pivotally attached to said first frame, said second frame being movable between a rest position and an actuated position, said rest position being generally vertical and said actuated position being generally horizontal;

(d) a backrest pad attached to said second frame;

(e) a resistance means interconnecting said first and second frames; and (f) wherein said seat pad and said backrest pad form in combination a substantially continuous arcuate radius suitable for the stretching of back muscles when said movable backrest is disposed in said actuated position.

* * * * *